US005542142A

United States Patent [19]

Young

[11] Patent Number: 5,542,142

[45] Date of Patent: Aug. 6, 1996

[54] POND CLEANING DEVICE

[76] Inventor: Wayne C. Young, 1101 Camino Del Mar, Unit B, Del Mar, Calif. 92014

[21] Appl. No.: 452,301

[22] Filed: May 26, 1995

[51] Int. Cl.[6] ..... E04H 4/16

[52] U.S. Cl. ..... 15/1.7; 210/776

[58] Field of Search ..... 15/1.7, 344; 210/169, 210/767, 776, 514

[56] References Cited

U.S. PATENT DOCUMENTS

| | | | |
|---|---|---|---|
| 2,956,507 | 10/1960 | Hutchinson | 210/169 |
| 3,258,801 | 7/1966 | Campbell | 15/1.7 |
| 3,360,129 | 12/1967 | Powers | 210/169 |
| 3,630,364 | 12/1971 | Johnston | 210/169 |
| 3,820,182 | 6/1974 | Vockroth | 15/1.7 |
| 3,886,616 | 6/1975 | Hayes | 15/1.7 |
| 4,003,100 | 1/1977 | Whitaker | 15/1.7 |
| 4,094,031 | 6/1978 | Cellini | 15/1.7 |
| 4,584,733 | 4/1986 | Tietge et al. | 15/1.7 |
| 4,896,392 | 1/1990 | Hull et al. | 15/1.7 |
| 4,935,980 | 6/1990 | Leginus et al. | 15/1.7 |
| 4,944,101 | 7/1990 | Goble | 15/1.7 |
| 5,122,285 | 6/1992 | Tartal | 15/1.7 |
| 5,135,647 | 8/1992 | Childers | 15/1.7 |

*Primary Examiner*—David Scherbel
*Assistant Examiner*—Tony G. Soohoo
*Attorney, Agent, or Firm*—Brown, Martin, Haller & McClain

[57] ABSTRACT

A cleaning device for removing debris from a pond or other body of water is an elongated tubular member having an internal collection chamber for collecting water and debris, an inlet nozzle at the lower end of the member connected to the collection chamber, and an outlet at the upper end of the member also connected to the chamber. The outlet has an air hole which can be closed to trap air in the collection chamber while the lower end of the device is submerged in the water to a location adjacent debris to be collected. When the air hole is uncovered, water and debris will be drawn into the collection chamber through the inlet nozzle. The collected water and debris is trapped in the chamber while the device is moved from the water and taken to a disposal area, where it is inverted to drain collected water and debris from the chamber via the outlet.

8 Claims, 1 Drawing Sheet

POND CLEANING DEVICE

BACKGROUND OF THE INVENTION

The present invention relates to cleaning devices for cleaning ponds, pools, and other bodies of water.

Bodies of water such as ponds, pools, fountains, and the like will collect debris such as leaves, loose dirt, grit, and the like over time. Heavier debris will tend to sink and collect at the bottom of the pond. Fish ponds also tend to become dirty or polluted over time with particles of food, waste, fish scales and the like.

Various types of devices have been proposed in the past for cleaning bodies of water. Vacuum pump devices are sometimes used to collect debris from the surface of a pool. However, these devices are not able to effectively collect accumulated debris from the bottom of a pool.

Hand operated pumps have been proposed in the past for cleaning pools. For example, U.S. Pat. No. 4,584,733 of Tietge et al. describes a cleaning device comprising a tubular member with an open lower end and a piston slidably mounted in the tube for drawing water and debris into the tube through the open lower end. A filter for removing debris from the water drawn into the device is provided in the lower end of the tube. U.S. Pat. No. 4,094,031 of Cellini describes a similar hand operated pump device.

Other pool cleaning devices use suction to draw liquid and debris into the device and then filter the debris from the liquid before returning it to the pool. For example, in U.S. Pat. No. 4,944,101 of Goble a hollow tubular member is provided which has an aperture at the first end which may be opened or closed to release or trap air in the tubular member, an inlet at the second end, and an exhaust opening near the second end over which a filter is provided for trapping debris. The second end of the tubular member is extended into a body of water with the aperture closed to trap air in the tubular member. Once the second end is positioned close to debris to be removed, the aperture is opened to release the trapped air, and water and debris will be drawn into the tubular member through the inlet by suction. The water passes back out through the exhaust outlet, while any debris will be trapped in the filter. A similar device is described in U.S. Pat. No. 4,935,980 of Leginus et al. A water inlet tube has a nozzle end for placing next to debris to be collected, and extends into a water collecting chamber. An aperture is provided at the handle end of the device for opening or closing by the operator as necessary. A filter is provided in the lower end of the water collecting chamber. Water and debris is drawn into the collecting chamber, and water flows back out through the filter when the device is withdrawn from the pool, while debris is trapped on the filter at the lower end of the chamber.

Although these devices are suitable for cleaning bodies of water which do not have very large quantities of debris, if they are applied to fish ponds or other bodies of water having relatively large quantities of debris, the filter quickly becomes clogged. It is then necessary to disassemble the device in order to clean it and remove the debris.

SUMMARY OF THE INVENTION

It is an object of the present invention to provide a new and improved cleaning device for cleaning bodies of water, which is particularly suitable for fish ponds and like bodies of water which will have substantial quantities of submerged debris.

According to the present invention, a cleaning device for removing debris from bodies of water is provided, which comprises an elongate tubular member having an internal collection chamber, an inlet nozzle at a first end of the member connected to the collection chamber, a one way valve permitting liquid and debris to flow into the chamber through the inlet nozzle and preventing flow back out of the chamber through the inlet nozzle, and an opening at the opposite, second end of the tubular member which can be selectively opened or closed to allow air to flow from the tubular member or to trap air in the tubular member, the second end also comprising an outlet for flow of liquid and debris out of the chamber when the device is in an inverted orientation, the second end outlet comprising the only outlet for liquid out of the chamber.

In operation, the opening at the second end of the tubular member is closed and the first end is immersed below the surface of a pond or other body of water to be cleaned. Closing of the opening or air hole traps air in the device, and as the second end is submerged, hydrostatic pressure will build up. The length of the device will be sufficient to allow the second end to be placed close to the bottom of a body of water while the first end projects up out of the water and provides a handle for gripping by the user. The second end is positioned close to a region of debris and the air opening at the second end is released. The pressure differential will cause water and debris to be drawn in through the inlet nozzle while air flows out through the air opening at the top of the device. The water and debris are then trapped in the collection chamber. The device is then removed from the body of water and inverted over a disposal area, so that the collected water and debris flow out through the outlet. The device can then be used again to collect more water and debris in the same way.

This avoids the problem of filter clogging and avoids the need to disassemble the device repeatedly in order to clean a clogged filter. The removal of water along with accumulated debris is not a problem, particularly in a fish pond or the like where water must be replaced at periodic intervals to prevent the chemical concentration from becoming too high.

The tubular member preferably has a larger diameter portion extending from the first end and forming the collection chamber, and a smaller diameter, hollow handle portion extending from the larger diameter portion to the second end. The handle portion may simply be open at the second end to provide both the air inlet and outlet and the outlet for water and debris when the device is inverted. However, a removable end cap is preferably provided for engaging over the second end of the handle portion, and the cap has a reduced diameter opening or air hole which may be closed by the user's thumb in order to trap air. The cap may be removed if necessary prior to inverting the device to dump collected water and debris. Preferably, the cap is a simple press fit over the open second end of the device. The handle portion of the device is longer than the larger diameter portion, to provide an extended handle so that a person standing on the side of a pond or body of water and holding the handle portion can reach the center of a pool or pond easily with the second end of the device.

The cleaning device is simple and inexpensive to manufacture, and is easy and convenient to use. An entire body of water such as a fish pond can be cleaned without having to disassemble the device or remove clogged debris from the device.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
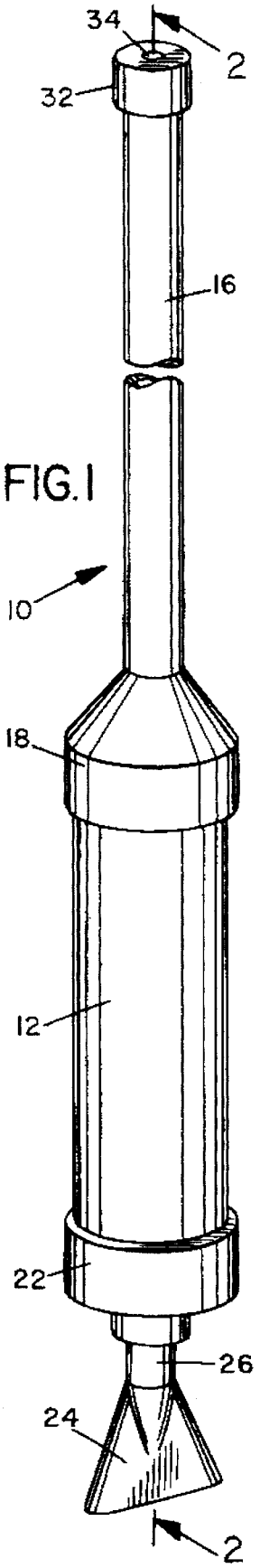
FIG. 1 is a perspective view of the suction cleaning device according to a preferred embodiment of the invention.

The drawings illustrate a cleaning device 10 according to a preferred embodiment of the invention for cleaning a body of water such as a fish pond or the like. The device 10 basically comprises an elongated tubular member having a lower tubular end portion 12 of enlarged diameter having an internal collection chamber 14 for collecting water and debris, and a reduced diameter, extended tubular handle portion 16 which is longer than the tubular end portion 12. Preferably, the tubular portions 12 and 16 each comprise a length of tubing of suitable material such as metal, plastic, PVC or the like. The lower end portion and handle portion are connected together by means of a connecting ring 18 having a through bore in which the end of handle portion 16 is secured, and an enlarged outer flange 20 secured over the open upper end of the lower tubular portion 12.

Figure 2:
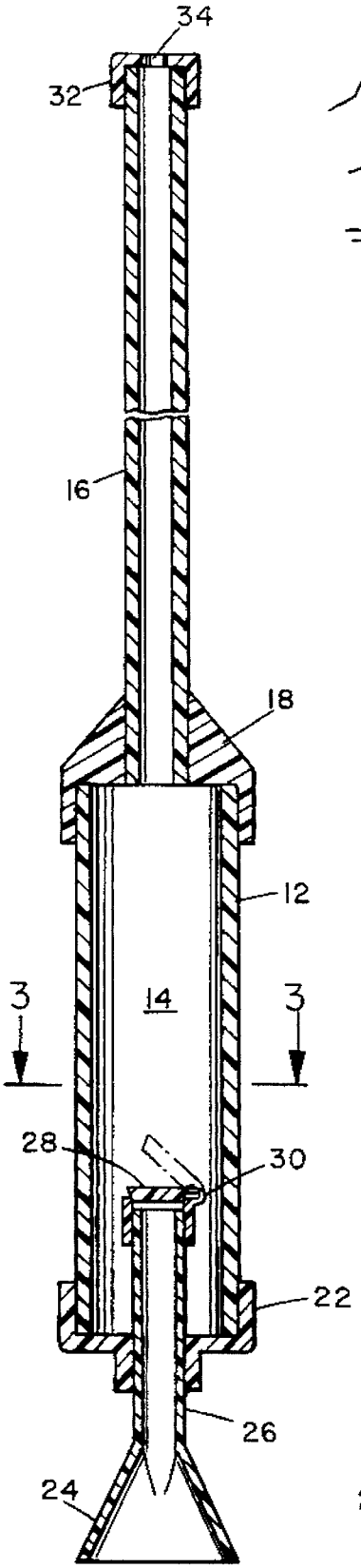
FIG. 2 is a sectional view taken on line 2—2 of FIG. 1.

A first end cap 22 is a press fit over the open lower end of the collection chamber 14. An inlet nozzle 24 has a flared opening 25 and a tubular stem 26 projecting into the collection chamber 14 through a central opening in the end cap 22, as best illustrated in FIG. 2. The nozzle may be secured in the opening by adhesive or the like. A one-way flap valve 28 is mounted over the inner end of stem 26. Valve 28 is pivotally connected to the stem 26 via a hinge 30 at one side for permitting the valve to pivot between the closed position illustrated in solid lines and the open position illustrated in dotted outline in FIG. 2.

Figure 4:
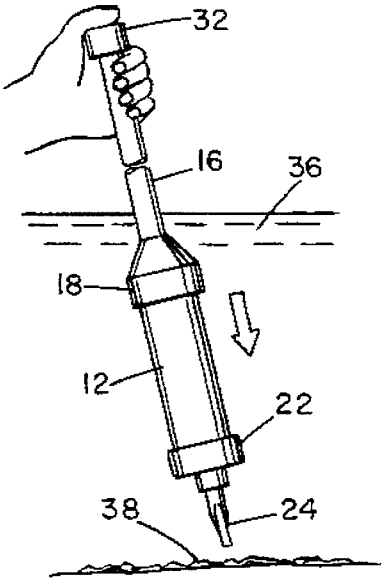
FIG. 4 illustrates the device in use.

A second or upper end cap 32 is a press fit over the open upper end of the handle portion 16. End cap 32 has a central air hole 34 which may be selectively closed by a person placing their thumb over the air hole as illustrated in FIG. 4.

Preferably, both end caps are a press fit over the respective ends of the lower and upper tubular portions, and the connecting ring 18 is also a press fit on the respective adjacent ends of the tubular portions. However, other types of interengagement may be provided between these parts of the device, such as screw threads or the like. The lower end cap and connecting ring may be permanently secured to the respective ends of the tubular portions by bonding, adhesives or the like. The end caps and connecting ring may be of the same or similar material to the tubular portions, such as PVC, plastics or the like.

In a preferred embodiment of the invention the outer diameter of the lower end portion 12 of the device was 4" while the outer diameter of the handle portion 16 was 1×5/16". The wall thickness of both tubular portions was 1/16". The tube or pipe preferably conforms to schedule 200 and is rated to 200 p.s.i. The length of the lower tubular portion 12 or chamber was 13½" while the length of the handle portion was 48". However, it will be understood that the handle portion may be made longer if necessary for larger bodies of water. The air hole 34 in cap 32 had a diameter of about 0.5", and the cap itself had a wall thickness of ⅛", and was in conformance with schedule 40. The cap is smooth fitting and easily removable.

Figure 5:
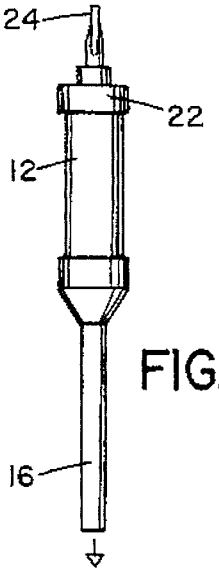
FIG. 5 illustrates the device inverted to drain the contents.
Figure 3:
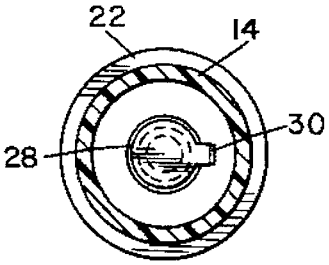
FIG. 3 is a sectional view taken on line 3—3 of FIG. 2.

Operation of the device for cleaning a pool or pond will now be described in more detail. The user first grips the end of handle portion 16 as illustrated in FIG. 3 so that their thumb covers the air hole 34 and traps air in chamber 14. The lower end of the device is then lowered into a body of water 36 until the inlet opening 25 at the lower end of nozzle 24 is located close to a region of debris 38 to be cleared from the bottom of the pond or pool. The resultant pressure differential will cause water and debris to be sucked into the collection chamber and air to rush out through opening 34 when the opening is uncovered. Once in the chamber, the water and debris will be trapped. The procedure may be repeated until the chamber is full. Once the chamber is full, the device is removed from the water, the end cap 32 is removed, and the device is inverted over a disposal area, as illustrated in FIG. 5. The water and debris in the collection chamber will then flow out through the open end of the handle portion 16. If the air hole 34 is large enough, it may not be necessary to remove the end cap before inverting the device, and water and debris may be allowed to exit through the hole 34. However, removal of cap 32 provides a larger outlet for debris.

Once the collected water and debris have been discarded, the device is again inverted into its upright orientation, the cap 32 is replaced, and the device is ready for use again to collect more water and debris. By holding the device at a shallow angle, it is possible to completely fill the collection chamber with water and debris, even in a relatively shallow pond. Since the device does not use any filters, the problem of filter clogging necessitating repeated disassembly and cleaning is avoided. The device is therefore quick and easy to use in cleaning a relatively large body of water or bodies of water containing large quantities of submerged debris. The construction is simple and therefore inexpensive, involving only one, simple moving part, which is the one-way valve 28.

The end cap 32 has a wall thickness which is sufficient for the cap to be rigid enough to be easily and smoothly removable and replaceable on the end of the handle portion by means of a simple, press fit. The internal diameters of the nozzle stem 26 and handle portion are such that debris will be unlikely to clog either of these passageways. If the air hole 34, which is the smallest diameter opening in the device, should become clogged, the cap 32 can be readily removed for cleaning the air hole and allowing debris and water to be drained out of the collection chamber via the open end of the handle portion 16. This provides a simple, inexpensive, hand-operated device for efficient removal of submerged debris and sediment from bodies of water such as fish ponds, pools, and the like.

Although a preferred embodiment of the invention has been described above by way of example only, it will be understood by those skilled in the field that modifications may be made to the disclosed embodiment without departing from the scope of the invention, which is defined by the appended claims.

I claim:

1. A pond cleaning device for removing debris from a body of water, comprising:

an elongated tubular member having an internal collection chamber, a lower end, and an upper end;

an inlet nozzle at the lower end of the tubular member and connected to said collection chamber;

the inlet nozzle having a one-way valve for permitting flow of liquid through the nozzle into the chamber and preventing flow of liquid out of the chamber via the nozzle;

the internal collection chamber having an upper end, a lower end wall through which said inlet nozzle projects, and only one outlet opening, said outlet opening being located at the upper end of the collection chamber and being connected to the upper end of the elongated tubular member; and the lower end wall of said chamber surrounding said inlet nozzle being imperforate;

the upper end having an opening which may be opened or closed to release or trap air in the suction chamber, and comprising a drain outlet for permitting flow of liquid and debris out of the chamber when the device is in an inverted orientation, the upper end outlet comprising the only outlet for liquid out of said collection chamber.

2. The device as claimed in claim 1, wherein the tubular member has a lower hollow tubular portion of a first diameter extending from said lower end and an upper hollow tubular portion of a second diameter smaller than said first diameter extending from the lower tubular portion to said upper end, the lower tubular portion defining said collection chamber and the upper tubular portion forming a passageway connecting the chamber outlet opening to the upper end opening for allowing liquid and debris to flow from the chamber to the upper end opening when the device is inverted.

3. The device as claimed in claim 2, wherein the upper tubular portion has a length which is at least double the length of the lower tubular portion.

4. The device as claimed in claim 1, wherein the upper end of the tubular member is open and a removable end cap is releasably mounted over the upper end of the tubular member, the end cap having an air hole comprising said opening for selectively trapping and releasing air from said chamber, the open upper end of the tubular member and the air hole in the end cap selectively comprising said drain outlet when said device is inverted with the end cap removed and the end cap in position over the upper end, respectively.

5. The device as claimed in claim 4, wherein said air hole has a diameter of at least 0.5".

6. The device as claimed in claim 4, wherein said end cap is a press fit over the upper end of the tubular member.

7. A method of removing debris from a body of water, comprising the steps of:

providing an elongate tubular member having a lower end and an upper end, an internal collection chamber, an inlet nozzle at the lower end connected to the collection chamber, and an air hole at the upper end connected to the collection chamber;

inserting the lower end of the device into a body of water with the air hole covered to trap air in the collection chamber and submerging the device to a sufficient extent to position the inlet nozzle adjacent debris to be removed;

uncovering the air hole to release trapped air and draw water and debris into the collection chamber through the inlet nozzle by suction;

trapping the collected debris and water in the collection chamber while lifting the device out of the body of water;

moving the device to a disposal area and inverting the device over the disposal area to allow all of the collected water and debris to drain out through said air hole at the upper end of the device; and repeating the foregoing steps until the desired amount of debris is removed.

8. The method as claimed in claim 7, wherein a removable end cap having said air hole is placed over the upper end of the tubular member during the collection of water and debris in said collection chamber, and the removable end cap is removed prior to inverting the device over a disposal area to drain collected water and debris through the open upper end of the tubular member.

* * * * *